US005929011A

United States Patent [19]

Scepanski

[11] Patent Number: 5,929,011

[45] Date of Patent: Jul. 27, 1999

[54] SOLID CAST CHLORINATED CLEANING COMPOSITION

[75] Inventor: William H. Scepanski, Bloomington, Minn.

[73] Assignee: Sunburst Chemicals, Inc., Minneapolis, Minn.

[21] Appl. No.: 08/961,322

[22] Filed: Oct. 30, 1997

Related U.S. Application Data

[60] Provisional application No. 60/030,098, Oct. 30, 1996.

[51] Int. Cl.[6] ..... C11D 3/395; C11D 9/42; C11D 17/06

[52] U.S. Cl. ..... 510/294; 252/187.34; 510/298; 510/302; 510/355; 510/445; 510/446

[58] Field of Search ..... 252/187.34; 510/294, 510/298, 302, 355, 446, 445

[56] References Cited

U.S. PATENT DOCUMENTS

| | | | |
|---|---|---|---|
| Re. 32,763 | 10/1988 | Fernholtz et al. . | |
| Re. 32,818 | 1/1989 | Fernholtz et al. | 510/445 X |
| 3,429,821 | 2/1969 | Weinstein et al. | 510/302 X |
| 3,759,834 | 9/1973 | Parke et al. | 510/294 X |
| 3,908,045 | 9/1975 | Alterman et al. | 427/213 |
| 3,956,160 | 5/1976 | Watanabe et al. | 510/355 X |
| 3,983,252 | 9/1976 | Alterman et al. | 428/403 |
| 3,983,254 | 9/1976 | Buchalter | 424/333 |
| 4,206,069 | 6/1980 | Borrello | 510/294 X |
| 4,512,908 | 4/1985 | Heile | 510/221 |
| 4,595,520 | 6/1986 | Heile et al. | 510/380 |
| 4,655,780 | 4/1987 | Chun et al. | 510/302 X |
| 4,657,784 | 4/1987 | Olson | 427/213 |
| 4,680,134 | 7/1987 | Heile et al. | 510/445 X |
| 4,681,696 | 7/1987 | Bruegge et al. | 252/187.34 X |
| 4,681,914 | 7/1987 | Olson et al. | 510/302 X |
| 4,707,160 | 11/1987 | Chun et al. | 8/101 |
| 4,731,195 | 3/1988 | Olson | 252/186.34 |
| 4,861,518 | 8/1989 | Morganson et al. | 510/214 |
| 4,863,632 | 9/1989 | Aronson et al. | 252/186.35 |
| 4,913,832 | 4/1990 | Kruse et al. | 252/187.34 X |
| 5,080,819 | 1/1992 | Morganson et al. | 510/445 X |
| 5,133,892 | 7/1992 | Chun et al. | 510/224 |
| 5,213,705 | 5/1993 | Olson | 252/186.35 |
| 5,358,653 | 10/1994 | Gladfelter, et al. | 510/514 |
| 5,397,506 | 3/1995 | Groth et al. | 510/294 X |
| 5,407,598 | 4/1995 | Olson et al. | 252/186.35 |
| 5,665,694 | 9/1997 | Backes et al. | 510/446 X |

*Primary Examiner*—Richard D. Lovering
*Attorney, Agent, or Firm*—Patterson & Keough, P.A.

[57] ABSTRACT

A solid cast detergent product containing an active chlorine source is disclosed. Methods of of manufacture and of use are also disclosed for the solid cast detergent product containing an active chlorine source.

36 Claims, 1 Drawing Sheet

SOLID CAST CHLORINATED CLEANING COMPOSITION

CROSS-REFERENCES TO RELATED APPLICATIONS

This application claims priority under 35 U.S.C. § 119(e) to U.S. Provisional Application No. 60/030,098, filed Oct. 30, 1996, the contents of which are hereby incorporated by reference.

BACKGROUND OF THE INVENTION

1. Field of the Invention

This invention relates to a solid cast composition containing surfactants, a chlorine source, optional alkalinity sources and optional detergent builders.

2. Background

Detergent products formulated with high levels of an active chlorine source, such as for example a mono- or dichloro(iso)cyanurate, tend to be unstable in response to a variety of conditions. Heat, acidity, and moisture are conditions especially which tend to promote instability of active chlorine sources. For example, heat normally causes the active chlorine source to liberate chlorine. Thus, manufacturing conditions and storage conditions dictate that constraints be placed on the usage of active chlorine sources such as the mono- or dichloro(iso)cyanurates.

Active chlorine sources are typically affected by low pH conditions which favor chlorine liberation. Thus, the presence of acidic materials in proximity to the active chlorine source must be considered in the manufacture of active chlorine source containing products and in the storage of such products.

Another factor which must be taken into consideration in the manufacture of a detergent product containing an (iso) cyanurate is water. Water generally promotes the liberation of chlorine from an (iso)cyanurate. In a detergent product containing a free fatty acid, a strong base such as sodium or potassium hydroxide and an active chlorine source, the reaction between the strong base and the fatty acid to form soap will also liberate water. The reaction of the strong base and the fatty acid to form a soap is an exothermic reaction.

As previously noted, the liberation of heat in an exothermic reaction promotes chlorine liberation from an active chlorine source. The water which is generated from the reaction of the strong base and the free fatty acid promotes the dispersion of the strong base and the fatty acid. These effects, especially when combined, might be thought of as almost similar to a catalytic effect in promoting or accelerating the reaction. As the reaction between the strong base and the free fatty acid proceeds further, quantities of heat are generated and more chlorine is liberated from the active chlorine source. In other words, these effects render manufacturing of such active chlorine containing detergent products very difficult.

If the source of alkalinity (the strong base) is sufficiently depleted, the chlorine generated may combine with the water to form an acid and to further reduce the pH in the vicinity of the active chlorine source. This, in turn, also further promotes the liberation of chlorine from the active chlorine source. Together with the previously mentioned problems, this effect further adds to the challenge of producing such a product.

Thus, one skilled in the art will normally avoid the use of ingredients which liberate chlorine gas which is a potentially flammable mixture and which could spontaneously ignite.

An alternative to avoiding the use of certain ingredients which favor chlorine generation from an active chlorine source is to stabilize the conflicting ingredients. Such attempts to stabilize conflicting ingredients are discussed below.

U.S. Pat. No. 3,908,045 issued to Alterman et al., Sep. 23, 1975 discloses particles of a fluidizable substance coated with a non-aqueous solution. Disclosures similar to U.S. Pat. No. 3,908,045 are found in U.S. Pat. No. 3,983,254 issued to Alterman et al., Sep. 28, 1976.

Chun et al., in U.S. Pat. No. 4,655,780 issued Apr. 7, 1987 discloses hard spherical bleaching particles utilizing an active halogen oxidizing material. U.S. Pat. No. 4,657,784 to Olson et al., issued Apr. 14, 1987 discusses the use of encapsulated halogen bleaches. U.S. Pat. No. 4,731,195 issued Mar. 15, 1988 to Olson et al., (a divisional of U.S. Pat. No. 4,657,784), contains similar disclosures.

The use of an active halogen bleach which is encapsulated with a synthetic detergent such as sodium octyl sulfonate is disclosed in U.S. Pat. No. 4,681,914 issued Jul. 21, 1987 to Olson et al. as well as in U.S. Pat. No. 5,407,598 issued Apr. 18, 1995 to Olson et al.

U.S. Pat. No. 5,213,705 which issued May 25, 1993 to Olson also discloses an active halogen bleach which is encapsulated with a synthetic detergent. Chun et al., in U.S. Pat. No. 4,707,160, issued Nov. 17, 1987, discloses particles with a core containing a halogen bleach. U.S. Pat. No. 5,133,892 issued Jul. 28, 1992 to Chun et al., discloses a multi layer detergent tablet.

Aronson et al., in U.S. Pat. No. 4,863,632 issued Sep. 5, 1989 discloses a bleaching particle having an oxidizing material surrounded by a polycarbonate coating. U.S. Pat. No. 5,358,653 issued to Gladfelter et al., Oct. 25, 1994 discloses a cleaning product containing a chlorine source.

None of the foregoing references discloses the combination of ingredients in a solid cast composition which are utilized in the present invention to prepare a stable active chlorine containing detergent composition. The method of manufacture of the composition of the present invention results in a surprisingly stable solid cast composition with ingredients that were previously considered incompatible with an active chlorine source.

The free fatty acid component of the invention is typically avoided in a cleaning product because the presence of hard water ions results in the formation of insoluble soap scum. The active chlorine source, while desirable for bleaching and disinfecting, is often avoided because of the problem of stabilizing the active chlorine source against the liberation of chlorine gas. The alkali metal hydroxide is often avoided because of the high pH potential when the alkali metal hydroxide is contacted with water. The detergent builders, while innocuous in most detergent products, are typically friable high melting point solids having hygroscopic properties. Thus, the inclusion of the detergent builder may aggravate the liberation of chlorine gas, raise the temperature required to disperse the remaining components of the solid cast detergent composition, and cause the solid cast detergent composition to be utilized unevenly.

Surprisingly, by practicing the present invention as described below, the challenge of manufacturing such a highly desirable product becomes quite manageable. Specifically, the present invention provides four important advantages: (1) chlorine liberation is minimized or eliminated; (2) the fatty acid reacts upon the addition of water with the alkali metal hydroxide to form a soap rather than to form a soap scum; (3) the water preferentially reacts with the fatty acid and the alkali metal hydroxide rather than liberating chlorine until the alkali metal source is largely depleted into the wash liquor; and (4) the detergent builder is not free to act hygroscopically. Moreover, the detergent builder does promote dispersion of the remaining ingredients in the solid cast detergent composition.

To the extent that the foregoing references are applicable to the present invention they are herein specifically incorporated by reference. Temperatures given herein are degrees Celsius unless otherwise indicated. Throughout the specification and claims, percentages and ratios are by weight unless otherwise indicated. Percentages are based upon the combined weight of the components recited in the pertinent claims. Ranges and ratios given herein may be combined.

SUMMARY OF THE INVENTION

The present invention, in a first embodiment is a solid cast detergent composition. The solid cast detergent composition includes a free fatty acid containing from about 8 to about 20 carbon atoms, an active chlorine source, and an alkali metal hydroxide. Prefereably, the moisture content of the composition is between greater than 0.1 weight percent and less than 5.0 weight percent.

A further aspect of the present invention is a solid cast detergent composition including a free fatty acid containing from about 8 to about 20 carbon atoms, an active chlorine source, and an alkali metal hydroxide wherein the solid cast detergent composition is prepared by the method including the following steps. First, the fatty acid is heated to above its melt point. After heating the heated fatty acid to above its melting point, the next step is to add the active chlorine source to form a mixture of the fatty acid and the active chlorine source. The mixture is maintained within not more than 30° C. above the melt point of the fatty acid, while adding to the mixture a member selected from the group consisting of: a detergent builder, an alkali metal hydroxide, and mixtures thereof. This forms a second mixture which includes the fatty acid, the active chlorine source and the member selected from the group consisting of: the detergent builder, the alkali metal hydroxide and mixtures thereof. The next step is casting the second mixture to obtain the cast detergent composition.

Yet a further version of the present invention is a solid cast detergent composition including:
a free fatty acid containing from about 8 to about 20 carbon atoms; an active chlorine source; a detergent builder; and an alkali metal hydroxide; wherein the composition is prepared by the method including the steps of: heating the fatty acid to above its melt point, thereafter adding the active chlorine source to the heated fatty acid to form a mixture of the fatty acid and the active chlorine source; maintaining the mixture within not more than 30° C. above the melt point of the fatty acid while adding to the mixture the detergent builder and the alkali metal hydroxide, to form a second mixture comprising the fatty acid, the active chlorine source and the member selected from the group consisting of the mixture the detergent builder and the alkali metal hydroxide, and casting the second mixture to obtain the solid cast detergent composition.

A further aspect of the present invention is a solid cast detergent composition including a free fatty acid containing from about 8 to about 20 carbon atoms; an active chlorine source; a detergent builder; and an excess of an alkali metal hydroxide over that required to neutralize the fatty acid.

In another version of the present invention, the invention is a solid cast detergent composition including a free fatty acid containing from about 8 to about 20 carbon atoms; an active chlorine source; a detergent builder; and an alkali metal hydroxide, wherein the active chlorine source has from 55 to 75% active chlorine.

In yet another version of the present invention, the invention is a solid cast detergent composition including: a free fatty acid containing from about 8 to about 20 carbon atoms; an active chlorine source; a detergent builder; and an alkali metal hydroxide; wherein the active chlorine source has from 58 than 70% active chlorine, and the active chlorine source is an alkali metal dichloro(iso)cyanurate.

In still one more version of the present invention, the invention is a solid cast detergent composition comprising from about 20 to 40 weight percent of a free fatty acid containing from about 8 to about 14 carbon atoms; from about 25 to 60 weight percent of sodium dichloro(iso) cyanurate; from about 5 weight percent to about 30 weight percent of sodium tripolyphosphate; and from about 15 weight percent to about 40 weight percent of potassium hydroxide.

The present invention also is a method of treating a fabric with a solid cast detergent composition, as described above, and including the steps of immersing a fabric in a quantity of water; contacting the solid cast detergent composition with water to form an aqueous mixture from at least a portion of the solid cast detergent composition, and thereafter contacting the portion with the fabric in the quantity of water thereby treating the fabric.

The present invention also is a method of treating a hard surface with a solid cast detergent composition, as described above, including the steps of: contacting the solid cast detergent composition with water to form an aqueous mixture from at least a portion of the solid cast detergent composition, and thereafter contacting the portion with the hard surface thereby treating the hard surface.

DETAILED DESCRIPTION OF THE INVENTION

Figure 1:
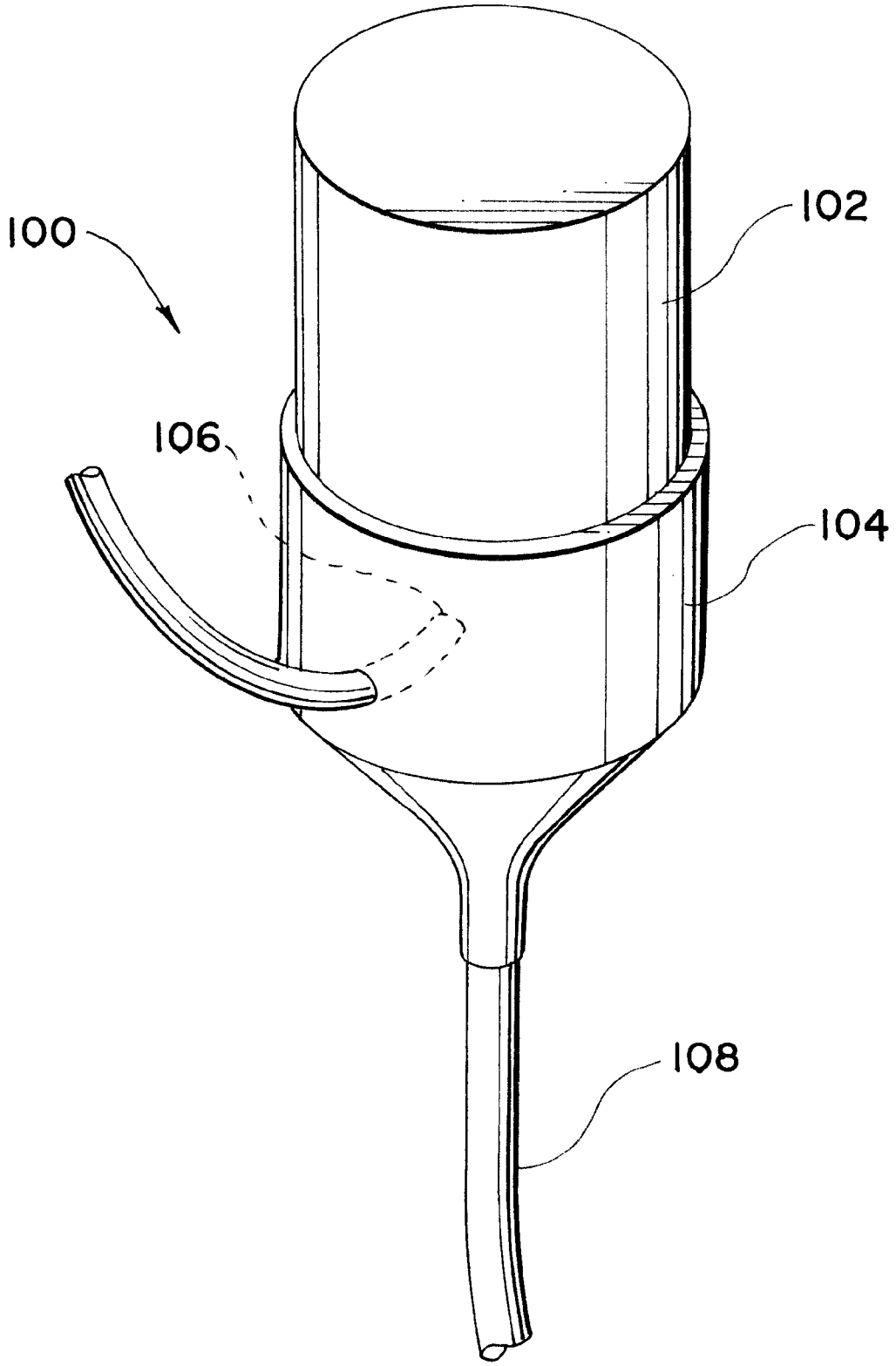
FIG. 1 is a schematic representation of a dispenser with a container (filled with a solid cast detergent composition of the present invention) with a tip for directing water into the open end of the container within the dispenser.

For purposes of explaining the present invention, the term "solid" is defined as an essentially homogeneous dispersion. A molten composition according to the present invention is conveniently placed in a container where it hardens into a solid cast. A solid cast composition is one that does not exit the container when the open container is inverted so the opening is on the bottom.

A solid cast composition is differentiated from a composition which, while solid, is powdered, particulate or granular. The solid cast will not exit an opened inverted container as opposed to the former products which are free flowing and not one discreet mass. For practical purposes the solid cast products of the present invention are those where the product will not pass through a 1.27 centimeter square sieve. Stated otherwise, the solid cast products of the present invention have dimensions, whether spherical, cylindrical; rectangular, elliptical or the like which are greater than 1.27 centimeters, preferably greater than 2.0 centimeters and more preferably greater than 4 centimeters. The size of the solid cast product is important in that smaller products present, for example, too much surface area available to water migration from the atmosphere which in turn results in loss of chlorine from the active chlorine source.

COMPONENTS

The fatty acids useful in the present invention are those which are rapidly convertible to a soap. These fatty acids from natural or synthetic sources contain from about 8 to about 20 carbon atoms; preferably from about 10 to about 14 carbon atoms; and most preferably from about 12 to about 14 carbon atoms. The preferred fatty acids for use in the present invention are those which melt and maintain a liquid status at a temperature below that at which the (iso) cyanurate component evolves substantial amounts of chlorine.

The fatty acids are preferably saturated, although if unsaturated it is preferred that the fatty acids have no more than one site of unsaturation in the fatty acid. The choice of saturated fatty acids is first to obtain the desired melt point such that the solid cast product will not require too high a temperature to manufacture. Excessively high melt temperatures may lead to chlorine loss from the active chlorine source. The second reason for selecting the saturated fatty acids is to ensure that the solid cast product will, under ambient conditions (for example, about 20° C.) be a solid. Of course, from a quality control standpoint the saturated fatty acids are more oxidatively stable and thus rancidity of the finished product is less likely.

The active chlorine source may be any of the active chlorine sources conventionally utilized in laundry and hard surface cleaning applications. Exemplary, but not limited to such materials, are sodium dichloro(iso)cyanurate and potassium dichloro(iso)cyanurate. Calcium hypochlorite and lithium hypochorite are also possible chlorine sources. If desired, an active chlorine source which is cation free may be utilized, such as, for example, trichloro(iso)cyanurate. However, as trichloro(iso)cyanurate (CBS) is highly reactive, its practical applications are somewhat limited. If it is desired, a mixture of the active chlorine source may be utilized and thus a mixture of trichloro(iso)cyanurate and sodium dichloro(iso)cyanurate or potassium dichloro(iso) cyanurate may be utilized.

The alkali metal hydroxide utilized in the present invention is a strong base. The alkali metal hydroxide is utilized to neutralize acid sources including the fatty acid to prevent liberation of the chlorine from the active chlorine source. The alkali metal hydroxide also generates soap in skit by neutralizing the fatty acid. If one were to use a soap instead of the mechanism of in skit generation of the soap, then the melt point of the soap would be so high as to effectively preclude the dispersion of the active chlorine source without substantial evolution of chlorine.

Excess amounts of the alkali metal hydroxide assist in cleaning and in peptizing soils. As previously noted the melt point of the alkali metal hydroxide permits easy mixture with the fatty acid. The alkali metal hydroxide is preferably employed neet in preparing the solid cast detergent composition.

The alkali metal hydroxide utilized in the present invention are lithium hydroxide (LiOH), sodium hydroxide (NaOH or caustic), and potassium hydroxide (KOH or caustic potash). In the order of interest in the present invention is a preference for the use of potassium hydroxide over sodium hydroxide over lithium hydroxide.

It should also be understood that a portion of the alkali metal hydroxide may be replaced with an alkali metal silicate as discussed under the heading of detergent builders. That is, the use of, for example, an meta-silicate will introduce substantial amounts of hydroxide into the solid cast detergent composition and thus the alkali metal silicate may be considered as a source of the alkali metal hydroxide.

OPTIONAL DETERGENT BUILDERS

Detergent builders (acid, neutral or most preferrably alkaline builders) may be added to the composition. Alkaline builders are water soluble bases added to detergent compositions to raise the pH of the cleaning solution. The detergent builder is suspended in the mass of the solid detergent during the production process. The amount of alkaline builder used will depend on the relative amounts of surfactants desired to achieve the proper cleaning effect. Too much alkaline builder should not be used because it will not become properly suspended in the melted surfactant during the manufacturing process.

Powdered, bead, liquid or granular alkaline builders can be used in the formulation of detergents of the invention. Generally, any water soluble base is appropriate, although certain bases are commonly used as alkaline builders in detergent compositions. Some alkaline builders that can be included in this product are: sodium or potassium silicate, sodium or potassium carbonate, trisodium or tripotassium phosphate, sodium or potassium borate, $Na_2HPO_4$, $K_2HPO_4$, sodium hydroxide, potassium hydroxide, monoethanolamine, diethanolamine, and triethanolamine.

Chelating, sequestering or scale inhibiting properties are important functions of the detergent builder to lessen the adverse consequences of having divalent and trivalent ions of calcium, magnesium, and iron and other less significant polyvalent metal cations in the washing solution. These divalent and trivalent cations enter the cleaning system with the water that is used as the main solvent in washing and rinsing, and with the soils present in the system that are to be removed. These divalent and trivalent ions reduce the effectiveness of a detergent composition. Subsequent reference to "hardness ions" refers to calcium, magnesium and, to a lesser degree, iron and other cations which are found in "hard water".

With the use of anionic surfactants, the hardness ions can combine with the anionic surfactant which not only reduces the surfactant's utility in solubilizing unwanted materials, but which can also precipitate the surfactant. If the surfactant precipitates, this adds to the soil with precipitated surfactant instead of removing it. The precipitated surfactant results, for example, in greasy films on hard surfaces or in gray to yellow tints on fabrics when used in laundry detergent compositions. Hardness ions can also precipitate fatty acids present in soils to prevent the solubilization and removal of the fatty acids by the surfactants. Inorganic anions such as carbonate, phosphate, silicate, sulfate, hydroxide and others can precipitate with hardness ions to form inorganic films, spots or deposits on hard surfaces and cleaning machines and devices or to form graying and discoloration of fabrics from the deposit of inorganic particles.

Sequestering or scale inhibiting chemicals will prevent these adverse effects because they bind the hardness ions. Binding of the sequestering agent to the ions keeps the hardness ions in solution and prevents the hardness ions from precipitating with the aforementioned organic and inorganic anions. Therefore, the addition of detergent builders having sequestering properties prevents mineral scale from building up on cleaning equipment, hard surfaces or fabrics being cleaned and promotes the rinsing of any residual hardness ion/sequestering agent complex that may have dried onto the substrate during the cleaning process.

Well known detergent builders used in this invention, include, but are not limited to, the following which are commercially available and commonly used in a detergent composition formulations:

1. Sodium, potassium, and ammonium salts of orthophosphate or polyphosphates such as pyrophosphate, tripolyphosphate, trimetaphosphate, hexametaphosphate or other higher complex phosphates having up to 22 phosphorus atoms in the anion.
2. Ethylenediamine tetraacetic acid or its fully or partially neutralized salts, e.g., sodium, potassium, ammonium or mono-, di- or triethanolamine salts.
3. Nitrilotriacetic acid or its full or partially neutralized salts, e.g., sodium, potassium, ammonium or mono, di or triethanolamine salts.
4. Other aminocarboxylic acids and their salts, for example:
   pentasodium diethylenetriamine pentaacetate,
   trisodium hydroxyethyl ethylenediamine,
   triacetate disodium ethanoldiglycine,
   sodium diethanolglycine,
5. Organic polycarboxylic acids and their salts, such as, oxalic acid, citric acid and gluconic acid.
6. Polyacrylic acid polymers and the sodium, potassium, ammonium or mono, di or triethanolamine salts from molecular weight 800 to 50,000.
7. Copolymers, of acrylic and maleic acid and the sodium, potassium, ammonium or mono, di or triethanolamine salts with molecular weights greater than 800.
8. Copolymers, of acrylic acid and itaconic acid and the sodium, potassium, ammonium or mono, di or triethanolamine salts with molecular weights between 800–50,000.
9. Copolymers, of maleic acid and itaconic acid and the sodium, potassium, ammonium or mono, di or triethanolamine salts with molecular weights between 800–50,000.
10. Amino trimethylene phosphonic acid and its sodium, potassium, ammonium or mono, di or triethanolamine salts.
11. 1-Hydroxyethylidine-1, 1-diphosphonic acid and its sodium, potassium, ammonium or mono, di or triethanolamine salts.
12. Hexamethylenediamine tetra(methylenephosphonic acid) and its sodium, potassium, ammonium or mono, di or triethanolamine salts.
13. Diethylene triamine penta(methylene phosphonic acid) and its sodium, potassium, ammonium or mono, di or triethanolamine salts.
14. Dequest 2041™ by Monsanto, which is a similar substituted phosphonic acid or salt.

AMOUNT OF THE COMPONENTS

Conveniently the amount of the fatty acid utilized to make the solid cast detergent composition is any amount sufficient to form a dominant phase in which to combine the other recited ingredients. In practice, the amount of the fatty acid utilized to make the solid cast detergent composition is from about 20 to 40 weight percent, preferably from about 22 to 38 weight percent, and most preferably from about 25 to 35 weight percent.

The active chlorine source utilized to make the solid cast detergent composition is any amount sufficient to provide the desired end use amount of the hypochlorite species for bleaching or disinfectant purposes. Typically, the amount of the active chlorine source utilized to make the solid cast detergent composition is from about 20 to 70 weight percent, preferably from about 25 to 60 weight percent, and most preferably from about 30 to 50 weight percent.

The amount of the alkali metal hydroxide, when utilized, is that amount sufficient to substantially convert the fatty acid to the corresponding alkali metal soap. Typically, the amount of the alkali metal hydroxide, when utilized, is from about 1.25 times to 3 times the stoichiometric amount needed to substantially convert the fatty acid to the corresponding alkali metal soap. The excess alkali metal hydroxide is useful in providing favorable cleaning conditions and in saponifying triglycerides. Also, because the alkali metal hydroxide is similar in melting point to the fatty acid, then the use of the alkali metal hydroxide further aids in dispersing the later discussed detergent builder.

The amount of the detergent builder, when utilized, is dependent upon the amount of water hardness to be controlled in the wash liquor. Typically, the amount of the detergent builder will be up to 50%, preferably from about 5 weight percent to about 50 weight percent, more favorably from about 5 weight percent to about 30 weight percent.

MANUFACTURE

To prepare the solid cast detergent product, the fatty acid is placed in a suitable mixing vessel. The mixing vessel also has heating means. The fatty acid may be added as a liquid or solid. Typically, the fatty acid will be heated from about 40° C. to 60° C.

The mixer is started and the active chlorine source is added. The detergent builder and/or the alkali metal hydroxide are then added. The product is then packaged, as later described, as soon as the product appears substantially homogenous. As there is the possibility that the product will generate heat from the exotherm of the contents of the vessel, the sooner the product is separated into smaller packages the better. That is, too much thermal energy in the vessel may cause localized hot spots and the spontaneous evolution of chlorine gas may begin.

In no specific or required order, the alkaline builders, chelating, sequestering or scale inhibiting agents are added with mixing. These materials do not necessarily dissolve, and they can remain discrete particles suspended essentially uniformly in the increasingly viscous, cooling fluid. As the mixture cools, mostly by the addition of cooler raw materials, its viscosity increases which aids in the suspension of the granular particles.

The mixture should preferably cool to below 50° C. keeping the texture of the mixture somewhat viscous but fluid, continuous mixing is employed to keep all ingredients suspended and homogeneously dispersed for uniform packaging. The mixture is packaged by pouring into plastic jars or bottles where it cools and solidifies.

A nonionic surfactant such as an alkyl ethoxylate may be added to the solid cast detergent composition. However, the nonionic surfactants are often liquids at room temperature and thus such nonionic surfactants should not be used in amounts where they bleed out of the solid cast detergent product.

Suitable anionic surfactants for addition to the solid cast detergent product are those generally incorporated into a detergent product. The difficulty in incorporating an anionic surfactant to the solid cast detergent composition resides in the high melting point of most anionic surfactants. Generally, a preferred group of anionic surfactants is a water-soluble alkyl or alkyl aryl sulfonate having from about 8 to about 22 carbons, preferably from about 12 to about 18 carbons, in the alkyl radical, which may be straight or branched chain. The sulfate or sulfonate group is typically base-neutralized to provide an alkali metal, especially sodium or potassium, ammonium, or mono, di-, or trialkanolium cation.

Illustrative anionic surfactants of the above-named classes include: sodium cetyl sulfate, sodium myristyl sulfate, sodium lauryl sulfate, sodium tallow sulfate, sodium decyl sulfate, sodium decylbenzene sulfonate, sodium tridecylbenzene sulfonate, sodium C 14 to C 16 olefin sulfonate, sodium C 12 to C 15 alcohol sulfate.

Synthetic anionic detergents useful herein include alkyl and alkyl ether sulfates. These materials have the respective formulae $ROSO_3M$ and $RO(C_2H_4O)_xSO_3M$ wherein R is alkyl or alkenyl of about 10 to about 20 carbon atoms, x is 1 to 10, and M is a water-soluble cation such as ammonium, sodium, potassium and triethanolamine. The alkyl ether sulfates useful in the present invention are condensation products of ethylene oxide and monohydric alcohols having about 10 to about 20 carbon atoms. Preferably, R has 14 to 18 carbon atoms in both the alkyl and alkyl ether sulfates. The alcohols can be derived from fats, e.g., coconut oil or tallow, or can be synthetic. Lauryl alcohol and straight chain alcohols derived from coconut oil are preferred herein. Such alcohols are reacted with 1 to 10, and especially 3, molar proportions of ethylene oxide and the resulting mixture of molecular species, having, for example, an average of 3 moles of ethylene oxide per mole of alcohol, is sulfated and neutralized.

Specific examples of alkyl ether sulfates of the present invention are sodium coconut alkyl triethylene glycol ether sulfate; lithium tallow alkyl triethylene glycol ether sulfate; and sodium tallow alkyl hexaoxyethylene sulfate. Highly preferred alkyl ether sulfates are those comprising a mixture of individual compounds, said mixture having an average alkyl chain length of from about 12 to 16 carbon atoms and an average degree of ethoxylation of from about 1 to 4 moles of ethylene oxide. Such a mixture also comprises from about 0 to 20% by weight C 12–13 compounds; from 60 to 100% by weight of C 14–15–16 compounds, from about 0 to 20% by weight of C 17–18–19 compounds; from about 3 to 30% by weight of compounds having a degree of ethoxylation of 0; from about 45 to 90% by weight of compounds having a degree of ethoxylation of from 1 to 4; from about 10 to 25% by weight of compounds having a degree of ethoxylation of from 4 to 8; and from about 0.1 to 15% by weight of compounds having a degree of ethoxylation greater than 8.

Other suitable anionic detergents utilizable herein are olefin sulfonates having about 12 to about 24 carbon atoms. The term "olefin sulfonates" is used herein to mean compounds which can be produced by the sulfonation of an alpha-olefin by means of uncomplexed sulfur trioxide, followed by neutralization of the acid reaction mixture in conditions such that any sulfonates which have been formed in the reaction are hydrolyzed to give the corresponding hydroxy-alkane sulfonates. The sulfur trioxide can be liquid or gaseous, and is usually, but not necessarily, diluted by inert diluents, for example by liquid $SO_2$, chlorinated hydrocarbons, etc., when used in the liquid form, or by air, nitrogen, gaseous $SO_2$, etc., when used in the gaseous form.

The alpha-olefin from which the olefin sulfonates are derived are mono-olefin having 12 to 24 carbon atoms, preferably 14 to 16 carbon atoms. Preferably, they are straight chain olefins. Examples of suitable 1-olefin components include 1-dodecene; 1-tetradecene; 1-hexadecene; 1-octadecene; 1-cicosene and 1-tetraeosene.

Additional surfactant materials which may be utilized herein include the following exemplified materials. Long chain tertiary amine oxides corresponding to the following general formula:

$$R^1R^2R^3NO$$

wherein $R^1$ contains an alkyl, alkenyl or monohydroxy alkyl radical of from about 8 to about 18 carbon atoms, from 0 to about 10 ethylene oxide moieties, and from 0 to 1 glyceryl moiety, and $R^2$ and $R^3$ contain from 1 to about 3 carbon atoms and from 0 to about 1 hydroxy group, e.g., methyl, ethyl, propyl, hydroxy ethyl, or hydroxy propyl radicals. The arrow in the formula is omitted as it is a conventional representation of a semi-polar bond between the nitrogen and the oxygen.

Examples of amine oxides suitable for use in this invention include dimethyldodecylamine oxide, oleyldi(2-hydroxyethyl)amine oxide, dimethyloctylamine oxide, dimethyldecylamine oxide, dimethyltetradecylamine oxide, 3,6,9-trioxaheptadecyldiethylamine oxide, di(2-hydroxyethyl)-tetradecylamine oxide, 2-dodecoxy-ethyldimethylamine oxide, 3-dodecoxy-2-hydroxypropyldi(3-hydroxy-propyl) amine oxide, and dimethyl-hexadecylamine oxide.

Further additional surfactants include long chain tertiary phosphine oxides corresponding to the following general formulas:

$$RR'R''PO$$

$$RO(CH_2CH_2O)_n—P(=O)[—(OM)_2]$$

$$[RO(CH_2CH_2O)_n—]2P(=O)—(OM)$$

wherein R contains an alkyl, alkenyl or monohydroxyalkyl radical ranging from 8 to 18 carbon atoms in chain length, from 0 to about 10 ethylene oxide moieties and from 0 to 1 glyceryl moiety and R' and R" are each alkyl or monohydroxyalkyl groups containing from 1 to 3 carbon atoms. The arrow in the formula is omitted as it is a conventional representation of a semi-polar bond between the phosphorus and the oxygen.

PRODUCT USAGE

A general method of use of a solid detergent of this invention is to dissolve the solidified product in water by appropriate and convenient means for the user to form a detergent solution or dispersion. The solution or dispersion formed can be directly used or diluted further before use. One preferred method of utilizing this invention employs the solid detergent plastic jars with an approximate volume of 1 to 5 quarts having an opening of 25 to 200 mm. Larger containers up to 55 gallon open head drums may be used. Another preferred method of using the detergent of the invention involves blocks or tablets of the detergent that can be directly used to produce detergent solution or dispersion. The dosage of the solid cast detergent product introduced to the wash liquor should typically form a wash liquor having a solids content (active ingredients) of 0.01 percent to about 5 percent by weight of the wash liquor.

When the detergent is used from a container, the container with the cooled and solidified detergent can be placed inverted into a bowl especially designed to dissolve solid detergent products. Water is sprayed upward into the inverted container dissolving the detergent. An example of an appropriate dispenser is given in U.S. Pat. No. 5,342,587 to Laughlin et al., entitled Detergent Dispenser For Use With Solid Cast Detergent, incorporated herein by reference.

An apparatus 100 for dispensing the solid detergent is schematically shown in FIG. 1. The container 102 of the solid detergent is inverted over a bowl 104. Water is sprayed from a tip 106 to dissolve the appropriate amount of detergent. The dissolved detergent runs down the bowl into a tube 108 for delivery to the appropriate location. There can be a screen between the sprayer and the detergent, but this is not preferred since the screen can reduce the effectiveness of the spray to dissolve the detergent.

The detergent solution or dispersion runs out through a tube in the bottom of the bowl by gravity and/or suction. The solution or dispersion flows through the tube either directly to a laundry machine, or to a collecting box where it is further mixed with water that carries or flushes the solution or dispersion into a laundry machine, or to a receptacle used to hold the detergent solution or dispersion for manual cleaning with a mop, brush, sponge, pad, rag, and the like, or to a flowing stream of water that feeds a hose or sprayer that is used to spray detergent solution or dispersions onto floors, walls, tables, food handling machinery and equipment, vehicles or any hard surface. Of course, other ways of dissolving the detergent from the container can be used.

Another method of use is based on solid blocks or tablets of the solid detergent. These blocks will generally range from 1 oz. to 5 lbs. One or more of these blocks are placed in a dispenser tub where water flows over the blocks, dissolving them to form a detergent solution or dispersion. The detergent solution or dispersion can be transferred to its use application by the methods mentioned above. Any of the optional ingredients discussed herein may be added via the solid cast detergent composition to the wash liquor or may be separately added to the wash liquor.

Details of the composition are illustrated by the following formulas which are prepared in laboratory batches and/or pilot plant scale ups of 80 kilograms or more:

| Ingredient | Wt % |
|---|---|
| Example 1 | |
| $C_{12}$ Fatty Acid | 28.0 |
| Sodium Dichloro(iso)cyanurate | 45.0 |
| Sodium Tripolyphosphate | 10.0 |
| Sodium Hydroxide | 17.0 |
| Example 2 | |
| $C_{12}$ Fatty Acid | 28.0 |
| Sodium Dichloro(iso)cyanurate | 40.0 |
| Sodium Tripolyphosphate | 10.0 |
| Sodium Hydroxide | 22.0 |
| Example 3 | |
| $C_{12}$ Fatty Acid | 20.0 |
| Sodium Dichloro(iso)cyanurate | 43.0 |
| Sodium Tripolyphosphate | 10.0 |
| Free Acid of Alkylphosphate Ester | 5.0 |
| Potassium Hydroxide | 22.0 |
| Example 4 | |
| $C_{12}$ Fatty Acid | 30.0 |
| Sodium Dichloro(iso)cyanurate | 33.0 |
| Tetra Potassium Pyrophosphate | 10.0 |
| Potassium Hydroxide | 23.0 |
| Sodium Lauryl Sulfate | 3.0 |

In the previous examples, the surfactant could have included any of the following which also function with the criteria of being stable in the presence of chlorine and having a moisture content of 5% by weight or less.

| Anionic Surfactants | Nonionic Surfactants |
|---|---|
| $C_8$–$C_{18}$ Fatty Acids and Salts | $C_8$–$C_{18}$ |
| Sodium Xylene Sulfonate | Alkyl Amine Oxides |
| Mono & Sialkylphosphate Esters | |
| Alkylated disulfonated diphenyl oxides | |
| Sodium $C_4$–$C_{18}$ Alkyl Sulfates | |

In previous examples the active chlorine source could have included potassium chlorinated (iso)cyanurates, chlorinated amines such as Chloramine T™, Lithium Hypochlorite and calcium hypochlorite.

The builder in the previous examples could have been replaced by any alkaline metal phosphate, silicate or hydroxide to provide alkalinity or any chlorine stable polyacrylate or phosphonate capable of sequestering hard water ions.

The above lists did not constitute all materials that could be covered in the invention but illustrate some possible, reasonable candidates. Any surfactant that does not adversely react with chlorine nor have more than 5% water is a candidate.

Another set of examples follow which also within the spirit and scope of this invention.

| Ingredient | Wt % |
|---|---|
| Example 5 | |
| $C_{14}$ Fatty Acid | 20.0 |
| Chlorinated Isocyanurate(CDB) | 50.0 |
| Sodium Tripolyphosphate(Tripoly) | 10.0 |
| Sodium Metasilicate | 20.0 |
| Example 6 | |
| Lauric Acid | 28.0 |
| Sodium Dichloro(iso)cyanurate | 41.8 |
| Sodium Polyacrylate | 5.0 |
| Caustic Potash | 26.0 |
| Example 7 | |
| $C_{12}$ Fatty Acid | 18.0 |
| Free Acid Phosphate Ester | 10.0 |
| Chlorinated Isocyanurate | 40.0 |
| Sodium Tripolyphosphate | 10.0 |
| Potassium Hydroxide | 22.0 |
| Example 8 | |
| $C_{12}$ Fatty Acid | 5.0 |
| Free Acid Phosphate Ester | 25.0 |
| Chlorinated Isocyanurate | 40.0 |
| Sodium Tripolyphosphate | 10.0 |
| Potassium Hydroxide | 20.0 |
| Example 9 | |
| Free Acid Phosphate Ester | 30.0 |
| Chlorinated Isocyanurate | 50.0 |
| NaOH | 20.0 |
| Example 10 | |
| $C_{10}$ Fatty Acid | 30.0 |
| Sodium Metasilicate | 5.0 |
| Sodium Tripolyphosphate | 12.0 |
| Chlorinated Isocyanurate | 33.0 |
| NaOH | 15.0 |
| Sodium Xylene Sulfonate | 5.0 |
| Example 11 | |
| $C_{10}$ Fatty Acid | 30.0 |
| $C_{14}$ Amine Oxide | 3.0 |
| Chlorinated Isocyanurate | 30.0 |
| Tetra Potassium Pyrophosphate | 12.0 |
| KOH | 25.0 |

-continued

| Ingredient | Wt % |
|---|---|
| Example 12 | |
| Alk. Disulfonated Diphenyl Oxide | 5.0 |
| Sodium Tripolyphosphate | 20.0 |
| $C_{14}$ Fatty Acid | 25.0 |
| Chlorinated Isocyanurate | 35.0 |
| Sodium Hydroxide | 15.0 |
| Example 13 | |
| $C_{12}$ Fatty Acid | 25.0 |
| Sodium Polyacrylate | 10.0 |
| Chlorinated Isocyanurate | 35.0 |
| KOH | 20.0 |
| Sodium Metasilicate | 10.0 |
| Example 14 | |
| $C_{12}$ Fatty Acid | 30.0 |
| Chlorinated Isocyanurate | 60.0 |
| Sodium Metasilicate | 10.0 |
| Example 15 | |
| $C_{10}$ Fatty Acid | 20.0 |
| $C_{18}$ Fatty Acid | 5.0 |
| Chlorinated Isocyanurate | 35.0 |
| Sodium Polyacrylate | 5.0 |
| Sodium Hexametaphosphate | 10.0 |
| KOH | 25.0 |
| Example 16 | |
| Free Acid Phosphate Ester | 30.0 |
| $C_{12}$ Fatty Acid | 15.0 |
| Chlorinated Isocyanurate | 6.0 |
| Sodium Tripolyphosphate | 24.0 |
| KOH | 25.0 |
| Example 17 | |
| Lauric Acid | 28.0 |
| Sodium Dichloro(iso)cyanurate | 40.0 |
| Sodium Tripolyphosphate | 10.0 |
| Potasium Hydroxide | 22.0 |

I claim:

1. A solid cast detergent composition comprising:

a free fatty acid containing from about 8 to about 20 carbon atoms;

an active chlorine source; and an alkali metal hydroxide.

2. The solid cast detergent composition of claim 1 wherein the moisture content is from greater than about 0.1 weight percent to less than about 5 weight percent based on the solid cast detergent composition.

3. The solid cast detergent composition of claim 1 wherein said solid cast detergent composition will not pass through a 1.27 centimeter square sieve.

4. The solid cast detergent composition of claim 1 additionally comprising a surfactant selected from the group consisting of anionic surfactants, nonionic surfactants, amphoteric surfactants and mixtures thereof.

5. The solid cast detergent composition of claim 1 wherein said free fatty acid contains from about 10 to about 14 carbon atoms.

6. A method of treating a fabric with the solid cast detergent composition of claim 1 comprising immersing the fabric in a quantity of water; contacting said solid cast detergent composition with water to form an aqueous mixture from at least a portion of said solid cast detergent composition, and thereafter contacting said portion with the fabric in said quantity of water thereby treating the fabric.

7. A method of treating a hard surface with a solid cast detergent composition of claim 1 comprising the steps of:

contacting said solid cast detergent composition with water to form an aqueous mixture from at least a portion of said solid cast detergent composition, and thereafter contacting said aqueous mixture with the hard surface thereby treating the hard surface.

8. A solid cast detergent composition comprising:

a free fatty acid containing from about 8 to about 20 carbon atoms;

an active chlorine source;

a detergent builder; and an alkali metal hydroxide.

9. The solid cast detergent composition of claim 8 wherein the moisture content is from greater than about 0.1 weight percent to less than about 5 weight percent based on the solid cast detergent composition.

10. The solid cast detergent composition of claim 8 additionally comprising a surfactant selected from the group consisting of anionic surfactants, nonionic surfactants, amphoteric surfactants and mixtures thereof.

11. The solid cast detergent composition of claim 8 wherein said free fatty acid contains from about 10 to about 14 carbon atoms.

12. A solid cast detergent composition comprising:

a free fatty acid containing from about 8 to about 20 carbon atoms;

an active chlorine source;

and a member selected from the group consisting of:

a detergent builder, an alkali metal hydroxide, and mixtures thereof, wherein said composition is prepared by the method of:

heating the fatty acid to above its melt point, thereafter adding to the heated fatty acid said active chlorine source to form a mixture of said fatty acid and said active chlorine source;

maintaining said mixture within not more than 30° C. above the melt point of the fatty acid while adding to said mixture a member selected from the group consisting of:

the detergent builder, the alkali metal hydroxide, and mixtures thereof, to form a second mixture comprising said fatty acid, said active chlorine source and said member selected from the group consisting of:

the detergent builder, the alkali metal hydroxide and mixtures thereof; and casting said second mixture to obtain said cast detergent composition.

13. The solid cast detergent composition of claim 12 wherein the moisture content is from greater than about 0.1 weight percent to less than about 5 weight percent based on the solid cast detergent composition.

14. The solid cast detergent composition of claim 12 wherein said solid cast detergent composition will not pass through a 1.27 centimeter square sieve.

15. The solid cast detergent composition of claim 12 additionally comprising a surfactant selected from the group consisting of anionic surfactants, nonionic surfactants, amphoteric surfactants and mixtures thereof.

16. The solid cast detergent composition of claim 12 wherein said free fatty acid contains from about 10 to about 14 carbon atoms.

17. The solid cast detergent composition of claim 12 wherein the detergent builder is present.

18. The solid cast detergent composition of claim 12 wherein the alkali metal hydroxide is present.

19. A solid cast detergent composition comprising:

a free fatty acid containing from about 8 to about 20 carbon atoms;

an active chlorine source;

a detergent builder; and an alkali metal hydroxide;

wherein said composition is prepared by the method of:

heating the fatty acid to above its melt point, thereafter adding to the heated fatty acid said active chlorine source to form a mixture of said fatty acid and said active chlorine source;

maintaining said mixture within not more than 30° C. above the melt point of the fatty acid while adding to said mixture the detergent builder and the alkali metal hydroxide, to form a second mixture comprising said fatty acid, said active chlorine sources, said detergent builder and said alkali metal hydroxide, and casting said second mixture to obtain said solid cast detergent composition.

20. The solid cast detergent composition of claim 19 wherein the moisture content is from greater than about 0.1 weight percent to less than about 5 weight percent based on the solid cast detergent composition.

21. The solid cast detergent composition of claim 19 wherein said solid cast detergent composition will not pass through a 1.27 centimeter square sieve.

22. The solid cast detergent composition of claim 19 wherein said free fatty acid contains from about 10 to about 14 carbon atoms.

23. A solid cast detergent composition comprising a free fatty acid containing from about 8 to about 20 carbon atoms; an active chlorine source; a detergent builder; and an excess of an alkali metal hydroxide over that required to neutralize said fatty acid.

24. A solid cast detergent composition comprising:

a free fatty acid containing from about 8 to about 20 carbon atoms;

an active chlorine source;

a detergent builder; and an alkali metal hydroxide, wherein said active chlorine source has from 56 to 70% active chlorine.

25. The solid cast detergent composition of claim 24 wherein the moisture content is from greater than about 0.1 weight percent to less than about 5 weight percent based on the solid cast detergent composition.

26. The solid cast detergent composition of claim 24 wherein said free fatty acid contains from about 10 to about 14 carbon atoms.

27. The solid cast detergent composition of claim 24 wherein said solid cast detergent composition will not pass through a 1.27 centimeter square sieve.

28. The solid cast detergent composition of claim 24 wherein said active chlorine source has from about 60 to about 70% active chlorine.

29. A solid cast detergent composition comprising:

a free fatty acid containing from about 8 to about 20 carbon atoms;

an active chlorine source;

a detergent builder; and an alkali metal hydroxide;

wherein said active chlorine source has from 58 than 70% active chlorine, and said active chlorine source is an alkali metal dichloro(iso)cyanurate.

30. The solid cast detergent composition of claim 29 wherein the moisture content is from greater than about 0.1 weight percent to less than about 5 weight percent based on the solid cast detergent composition.

31. The solid cast detergent composition of claim 29 wherein the alkali metal is potassium.

32. The solid cast detergent composition of claim 29 wherein the alkali metal is sodium.

33. A solid cast detergent composition comprising from about 20 to 40 weight percent of a free fatty acid containing from about 8 to about 14 carbon atoms; from about 25 to 60 weight percent of sodium dichloro(iso)cyanurate; from about 5 weight percent to about 30 weight percent of detergent builder; and from about 15 weight percent to about 40 weight percent of potassium hydroxide.

34. The solid cast detergent composition of claim 33 wherein the detergent builder is sodium tripolyphosphate.

35. The solid cast detergent composition of claim 33 wherein the detergent builder is sodium polyacrylate.

36. The solid cast detergent composition of claim 33 wherein the moisture content is from greater than about 0.1 weight percent to less than about 5 weight percent based on the solid cast detergent composition.

* * * * *

UNITED STATES PATENT AND TRADEMARK OFFICE

CERTIFICATE OF CORRECTION

PATENT NO. : 5,929,011

DATED : July 27, 1999

INVENTOR(S) : Scepanski

It is certified that error appears in the above-identified patent and that said Letters Patent is hereby corrected as shown below:

In the Abstract, line 3, after "of" delete "of".

Column 3, line 22, delete "Prefereably," and insert --Preferably--.

Column 3, line 45, after "including:" do not begin a new paragraph; continue with "a free fatty . . .".

Column 4, line 16, after "(iso)" insert -- - --.

Column 4, line 60, after "cylindrical" delete ";" and insert --,--.

Column 5, line 9, after "(iso)" insert -- - --.

Column 5, line 33, delete "(CBS)" and insert --(CDB)--.

Column 5, lines 43 and 45, delete "skit" and insert --situ--.

Column 5, line 53, delete "neet" and insert --neat--.

Column 5, line 55, delete "hydroxide" and insert --hydroxides--.

Column 5, line 64, delete "an" and insert --a--.

Column 6, line 2, delete "preferrably" and insert --preferably--.

UNITED STATES PATENT AND TRADEMARK OFFICE

CERTIFICATE OF CORRECTION

PATENT NO. : 5,929,011
DATED : July 27, 1999
INVENTOR(S) : Scepanski

It is certified that error appears in the above-identified patent and that said Letters Patent is hereby corrected as shown below:

Column 6, line 14, delete "Powdered" and insert --Powder--.

Column 6, line 41, after "soil" delete "with precipitated surfactant".

Column 6, line 66, after "in" delete "a".

Column 7, line 8, after mono" and "di" delete "-".

Column 7, line 18, delete "," and insert --.--.

Column 9, line 1, after "di" delete "-".

Column 10, line 47, after "containers" insert --of--.

Column 11, line 62, insert --Carboxymethylcellulase 1.0--.

Column 12, lines 4-5, "Alkyl Amine Oxides" should be after "$C_8$-$C_{18}$".

Column 12, line 6, delete "Sialkylphospate" and insert --Dialkylphosphate--.

Column 12, line 25, after "which" insert --are--.

UNITED STATES PATENT AND TRADEMARK OFFICE

CERTIFICATE OF CORRECTION

PATENT NO. : 5,929,011 page 3 of 3

DATED : July 27, 1999

INVENTOR(S) : Scepanski

It is certified that error appears in the above-identified patent and that said Letters Patent is hereby corrected as shown below:

Column 16, line 19, after "58" insert --to less--.

Signed and Sealed this

Second Day of January, 2001

*Attest:*

*Attesting Officer*

Q. TODD DICKINSON

*Commissioner of Patents and Trademarks*